US011963585B2

(12) United States Patent
Chen

(10) Patent No.: US 11,963,585 B2
(45) Date of Patent: Apr. 23, 2024

(54) FASTENING DEVICE AND METHOD FOR INSTALLING FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 253 days.

(21) Appl. No.: 17/650,526

(22) Filed: Feb. 10, 2022

(65) Prior Publication Data

US 2022/0312901 A1 Oct. 6, 2022

(30) Foreign Application Priority Data

Mar. 31, 2021 (TW) ..... 110111715

(51) Int. Cl.
*A43C 11/16* (2006.01)
*A43C 11/20* (2006.01)
*A43C 7/08* (2006.01)

(52) U.S. Cl.
CPC ..... *A43C 11/165* (2013.01); *A43C 11/20* (2013.01); *A43C 7/08* (2013.01)

(58) Field of Classification Search
CPC ..... A43C 11/165; A43C 11/20; A43C 7/08; A43C 11/14; B65H 75/4492
See application file for complete search history.

(56) References Cited

U.S. PATENT DOCUMENTS

| | | | | |
|---|---|---|---|---|
| 10,413,019 | B2 * | 9/2019 | Soderberg | A43C 11/165 |
| 2013/0118043 | A1 * | 5/2013 | Favier | G09F 7/06 40/518 |
| 2014/0359981 | A1 | 12/2014 | Cotterman et al. | |

FOREIGN PATENT DOCUMENTS

| | | | |
|---|---|---|---|
| CN | 104010543 | A | 8/2014 |
| JP | S60-170109 | U | 11/1985 |
| JP | 2016520401 | A | 7/2016 |
| JP | 2016-530028 | A | 9/2016 |
| KR | 10-1415495 | B1 | 7/2014 |
| KR | 10-2020-0126596 | A | 11/2020 |
| KR | 20200126596 | A | 11/2020 |
| TW | 202029901 | A | 8/2020 |

* cited by examiner

*Primary Examiner* — David M Upchurch
(74) *Attorney, Agent, or Firm* — CKC & Partners Co., LLC

(57) ABSTRACT

A fastening device is configured to be installed on an article and includes a base, an installing assembly and a reel part. The base is located on the article. The installing assembly includes at least one needle which is pivotally disposed at the base so as to rotate relatively to the base. The reel part is coupled to a lace and disposed on the base. The at least one needle is inserted from a first surface of the article into a second surface of the article, then inserted from the second surface of the article into the first surface of the article, and the at least one needle is restricted to the article for securing the base on the first surface of the article.

9 Claims, 14 Drawing Sheets

140

240

500

FASTENING DEVICE AND METHOD FOR INSTALLING FASTENING DEVICE

RELATED APPLICATIONS

This application claims priority to Taiwan Application Serial Number 110111715, filed Mar. 31, 2021, which is herein incorporated by reference.

BACKGROUND

Technical Field

The present disclosure relates to a fastening device and a method for installing a fastening device. More particularly, the present disclosure relates to a fastening device which is used to be installed on an article and can fasten a lace and a method for installing a fastening device.

Description of Related Art

In general, a wearable article can include a first side and a second side. The second side is opposite to the first side, and the first side and the second side are closed to tighten the wearable article to a worn part. For example, a shoe can include a shoe tongue which is located between the first side and the second side. The shoe can further include a plurality of eyelets which are arranged at the first side and the second side. In the conventional art, the shoelace can pass through the eyelets, and then be tied so as to fasten the article.

However, the shoelace has to be loosened before taking off the shoes, and then the shoelace has to be tied again when wearing the shoes. Thus, it causes great inconvenience. To solve the aforementioned problem, some practitioners develop a fastening device which can be deposed on the shoe tongue and coupled to a lace, wherein the lace can pass through the eyelets and replace the shoelace. By operating the fastening device, the lace can be loosened and tightened quickly so as to allow the shoes to be worn or taken off easily.

In the present art, the fastening device is fixed on the shoe tongue during the post-processing of the shoe. In other words, if the shoe is not configured to be an article having a fastening device, the user can hardly couple the fastening device to the shoe. Therefore, some practitioners develop another kind of fastening device which includes a positioning sheet. The positioning sheet includes a plurality of positioning holes so that the lace can pass through the eyelets and the positioning holes, and then be coupled to a reel part of the fastening device. Hence, the fastening device can be coupled to the shoe article. However, when the user loosens the lace, a gap is formed between the positioning sheet and the shoe article. In the result, the shaking occurs on the fastening device so as to cause inconvenience of using. Similarly, the same problem occurs when the fastening device is applied to other wearable articles.

Based on the above-mentioned problems, how to improve the structure of the fastening device to increase the flexibility and stability when installing the fastening device on the article becomes a pursued target of practitioners.

SUMMARY

According to one aspect of the present disclosure, a fastening device is provided. The fastening device is configured to be installed on an article and includes a base, an installing assembly and a reel part. The base is located on the article. The installing assembly includes at least one needle pivotally disposed at the base so as to rotate relatively to the base. The reel part is coupled to a lace and disposed on the base. The at least one needle is inserted from a first surface of the article into a second surface of the article, then inserted from the second surface of the article into the first surface of the article, and the at least one needle is restricted to the article for securing the base on the first surface of the article.

According to another aspect of the present disclosure, a method for installing a fastening device is provided. The method includes performing an aligning step and performing an inserting and installing step. The aligning step is performed to align at least one needle of a fastening device with an article. The inserting and installing step is performed to insert an inserting section of the at least one needle from a first surface of the article into a second surface of the article, then insert the inserting section of the at least one needle from the second surface of the article into the first surface of the article, and restrict the inserting section of the at least one needle to the article.

BRIEF DESCRIPTION OF THE DRAWINGS

The present disclosure can be more fully understood by reading the following detailed description of the embodiment, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on", "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
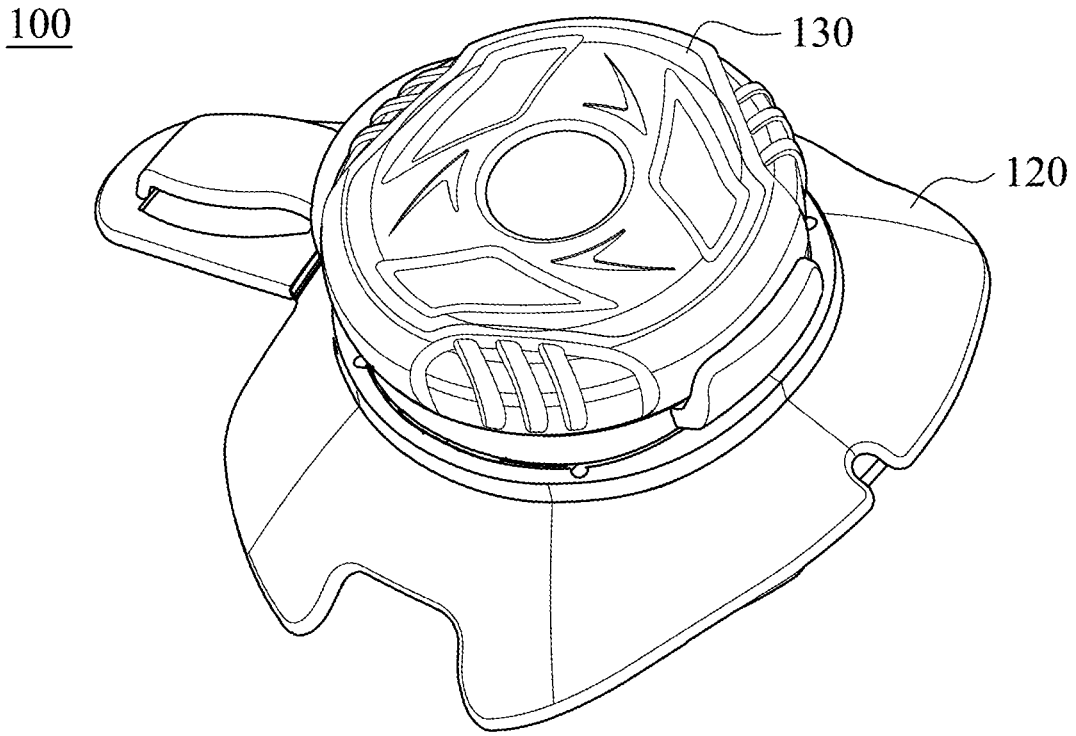
FIG. 1 shows a three-dimensional schematic view of a fastening device according to the 1st embodiment of the present disclosure.
Figure 2:
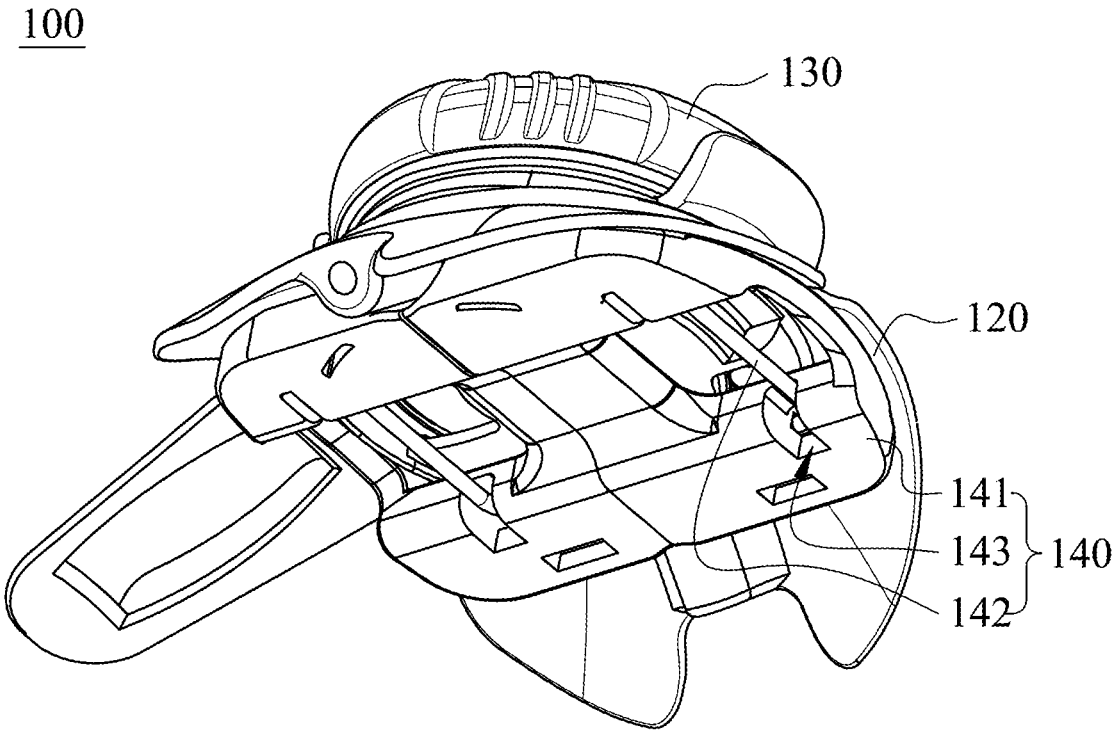
FIG. 2 shows another three-dimensional schematic view of the fastening device of the 1st embodiment in FIG. 1.
Figure 3:
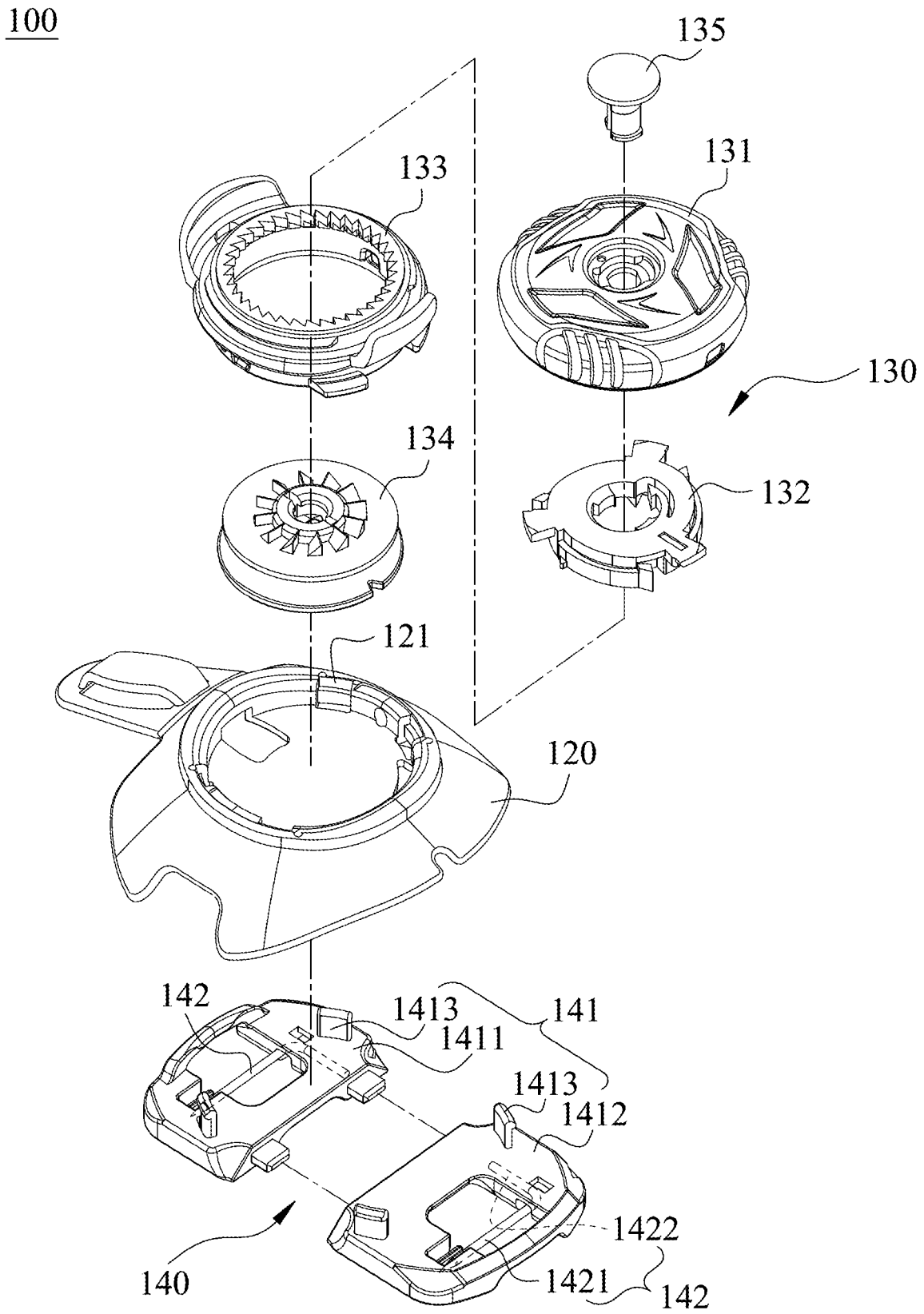
FIG. 3 shows an exploded schematic view of the fastening device of the 1st embodiment in FIG. 1.

Please refer to FIGS. 1, 2 and 3. FIG. 1 shows a three-dimensional schematic view of a fastening device 100 according to the 1st embodiment of the present disclosure. FIG. 2 shows another three-dimensional schematic view of the fastening device 100 of the 1st embodiment in FIG. 1. FIG. 3 shows an exploded schematic view of the fastening device 100 of the 1st embodiment in FIG. 1. The fastening device 100 is configured to be installed on an article S1 (shown in FIG. 7) and includes a base 120, an installing assembly 140 and a reel part 130. The base 120 is located on the article S1, and the installing assembly 140 includes at least one needle 142. The aforementioned at least one needle 142 is disposed at the base 120 so as to rotate relatively to the base 120. The reel part 130 is coupled to a lace and disposed on the base 120. The aforementioned at least one needle 142 is inserted from a first surface S11 (shown in FIG. 7) of the article S1 into a second surface S12 (shown in FIG. 7) of the article S1, then inserted from the second surface S12 of the article S1 into the first surface S11 of the article S1, and the aforementioned at least one needle 142 is restricted to the article S1 for securing the base 120 on the first surface S11 of the article S1.

Hence, the fastening device 100 can be installed and secured on the article S1 via the aforementioned at least one needle 142, and the stability and the flexibility of installing can be improved.

The reel part 130 can include a knob 131, an engaging unit 132, a case 133, a spool 134 and a restricting shaft 135. The spool 134 and the engaging unit 132 are received in the case 133, and the knob 131 covers the case 133. The restricting shaft 135 inserts the knob 131 downwardly so as to be coupled to the spool 134. Therefore, after the fastening device 100 is installed and secured on the article S1 via the aforementioned at least one needle 142, the lace can pass through eyelets (not shown) and be wound on the spool 134, and then the knob 131 can be operated to tighten the lace, thereby tightening the article S1.

Figure 4:
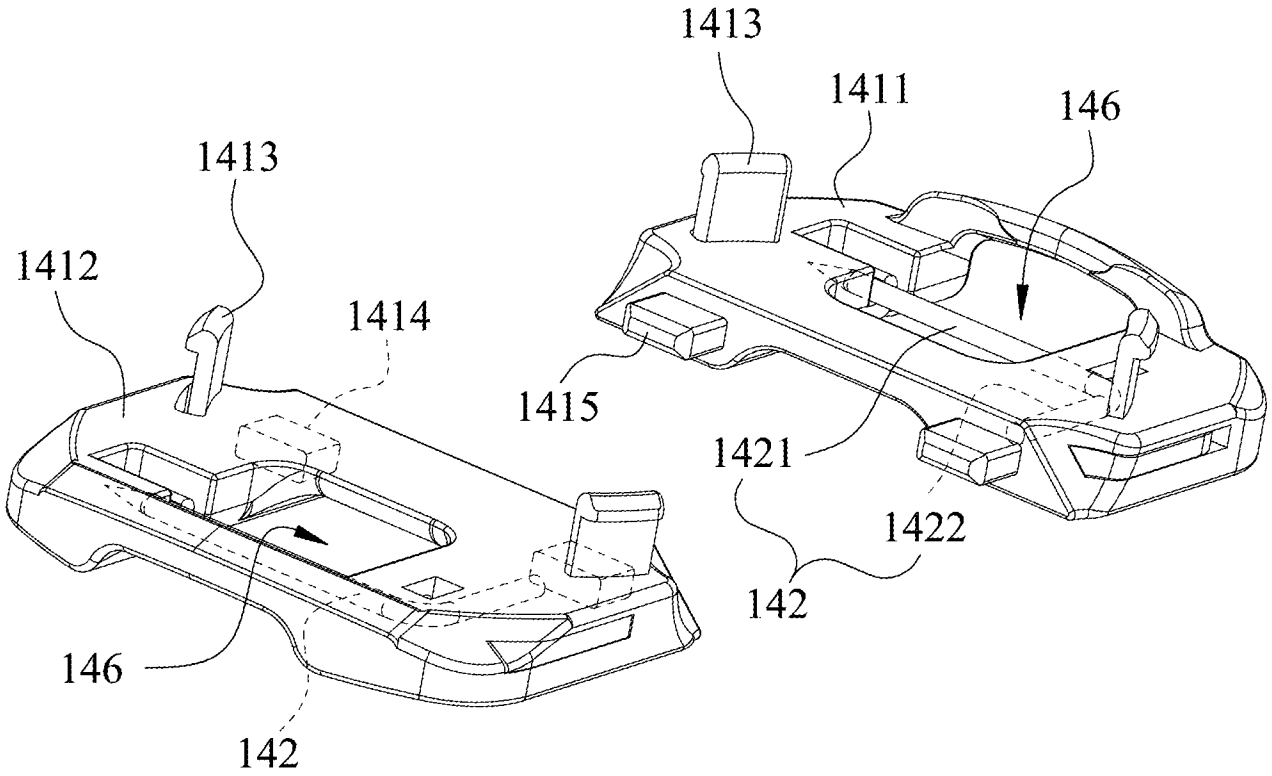
FIG. 4 shows a schematic view of the installing assembly of the fastening device of the 1st embodiment in FIG. 1.
Figure 5:
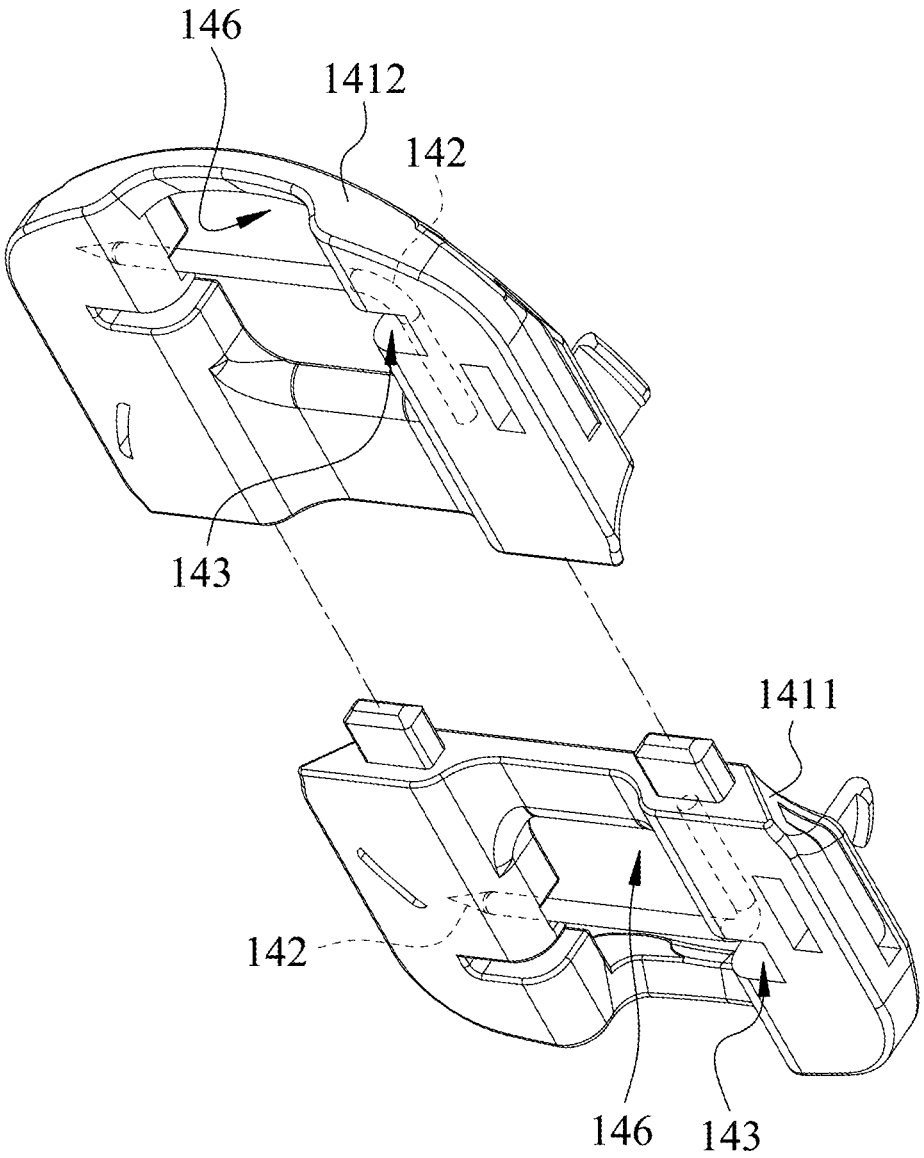
FIG. 5 shows another schematic view of the installing assembly of the fastening device of the 1st embodiment in FIG. 1.
Figure 6:
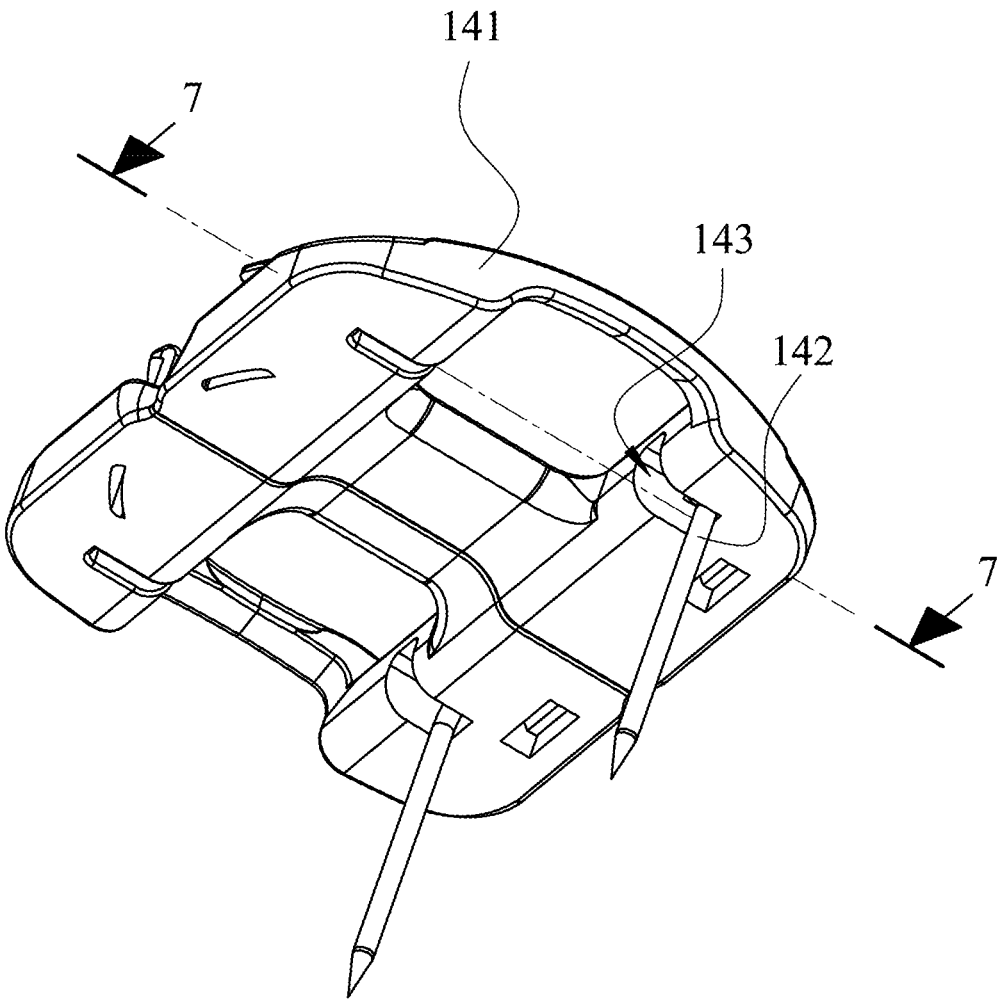
FIG. 6 shows an operation of the installing assembly of the fastening device of the 1st embodiment in FIG. 1.

Please refer to FIGS. 4, 5 and 6. FIG. 4 shows a schematic view of the installing assembly 140 of the fastening device 100 of the 1st embodiment in FIG. 1. FIG. 5 shows another schematic view of the installing assembly 140 of the fastening device 100 of the 1st embodiment in FIG. 1. FIG. 6 shows an operation of the installing assembly 140 of the fastening device 100 of the 1st embodiment in FIG. 1. The installing assembly 140 can further include a base plate 141. The base plate 141 is detachably mounted on the base 120. Because the base plate 141 is detachably mounted on the base 120, the base plate 141 and the at least one needle 142 can be mounted on the base 120 before the reel part 130 is mounted on the base 120 so as to improve easiness of installing.

In detail, the base plate 141 can include a first body 1411 and a second body 1412. The first body 1411 is engaged with the second body 1412. Two latches 1415 can be protruded from the first body 1411, and two inserting grooves 1414 can be recessed on the second body 1412. With each of the latches 1415 inserting into each of the inserting grooves 1414, the first body 1411 can be combined with the second body 1412, but the present disclosure is not limited thereto.

As shown in FIGS. 3 and 4, the base 120 can include at least one engaging portion 121, the base plate 141 can include at least one buckling portion 1413, and the aforementioned at least one buckling portion 1413 is correspondingly engaged with the aforementioned at least one engaging portion 121. In detail, a number of the buckling portions 1413 is four and each of the buckling portions 1413 has an arm structure. Two of the buckling portions 1413 are located on the first body 1411, and the other two of the buckling portions 1413 are located on the second body 1412. A number of the engaging portions 121 of the base 120 is four and each of the engaging portions 121 is a hole structure. By the mean that each of the buckling portions 1413 is buckled in each of the engaging portion 121, the base 120 can be combined with the installing assembly 140. Hence, when the user secures the installing assembly 140 on the article S1 and then combines the base 120 with the base plate 141, the lace can be coupled to the eyelets and inserted into the spool 134 of the reel part 130. After the lace passes out from the bottom of the spool 134 and is exposed beyond the case 133, the user can tie the lace to restrict the lace such that the lace can be coupled to the reel part 130. Then, the reel part 130 is engaged with the base 120, and the installing can be completed.

In the configuration, the installing assembly 140 can further include at least one pivot hole 143. The at least one pivot hole 143 is located at the base plate 141 and configured for the aforementioned at least one needle 142 to be pivotally disposed thereon. The at least one needle 142 can include an inserting section 1421 and a pivot section 1422. The inserting section 1421 and the pivot section 1422 are connected to form an L-shape. The inserting section 1421 rotates relatively to the base plate 141 about the pivot section 1422 which can be served as the rotary axis. Because a space can be formed in the pivot hole 143 for the inserting section 1421 to be disposed therein, the inserting section 1421 can be switched from the location parallel to the base plate 141 in FIG. 2 to the location perpendicular to the base plate 141 in FIG. 6.

According to the 1st embodiment in FIGS. 1-6, a number of the needles 142 can be two, and a number of the pivot holes 143 can be two. The needles 142 are located on the first body 1411 and the second body 1412, respectively. The pivot holes 143 are located on the first body 1411 and the second body 1412, respectively. Hence, one of the needles 142 can be pivotally disposed on the first body 1411, and the other one of the needles 142 can be pivotally disposed on the second body 1412. It is specified to be mentioned that, in the 1st embodiment, the needles 142 are fixed to the base plate 141, and the term "fixed" here does not mean the fixing during the manufacturing, but means that the needles 142 cannot be detachably disposed on the base plate 141.

Moreover, the installing assembly 140 can further include two through holes 146. As shown in FIG. 4, because the base plate 141 includes the first body 1411 and the second body 1412, one of the through holes 146 penetrates the first body 1411 along a thickness direction of the first body 1411, the other one of the through holes 146 penetrates the second body 1412 along a thickness direction of the second body 1412, and each of the through holes 146 corresponds to each inserting section 1421 of each of the needles 142. Hence, when the needles 142 are inserted into the article S1, if a part of the article S1 protrudes upward, the part of the article S1 can be stored in the through holes 146, and the base plate 141 can be prevented from tilting by pushing of the article S1.

Figure 7:
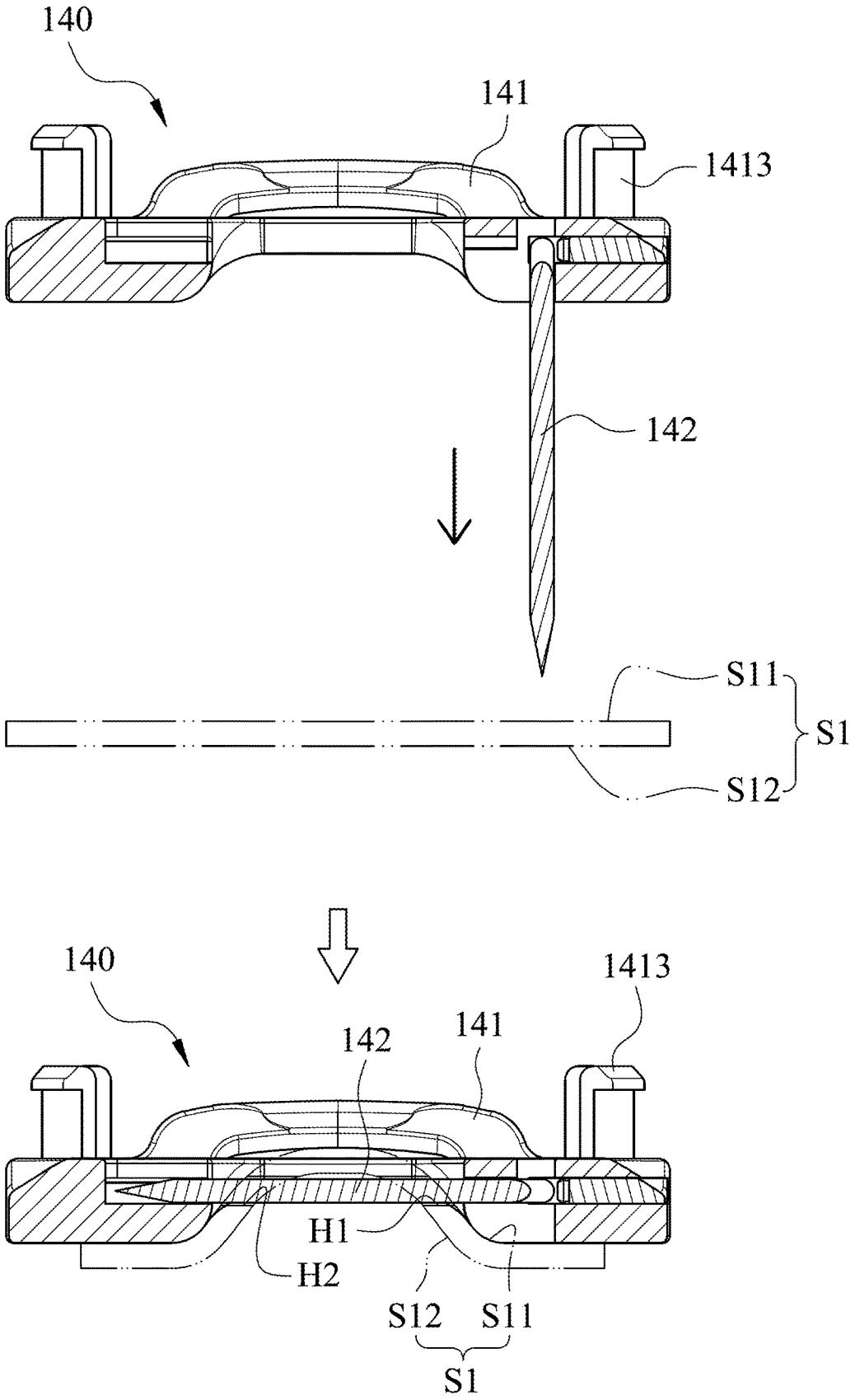
FIG. 7 shows an operation flow of the installing assembly of the fastening device taken along line 7-7 of the 1st embodiment in FIG. 6.
Figure 8:
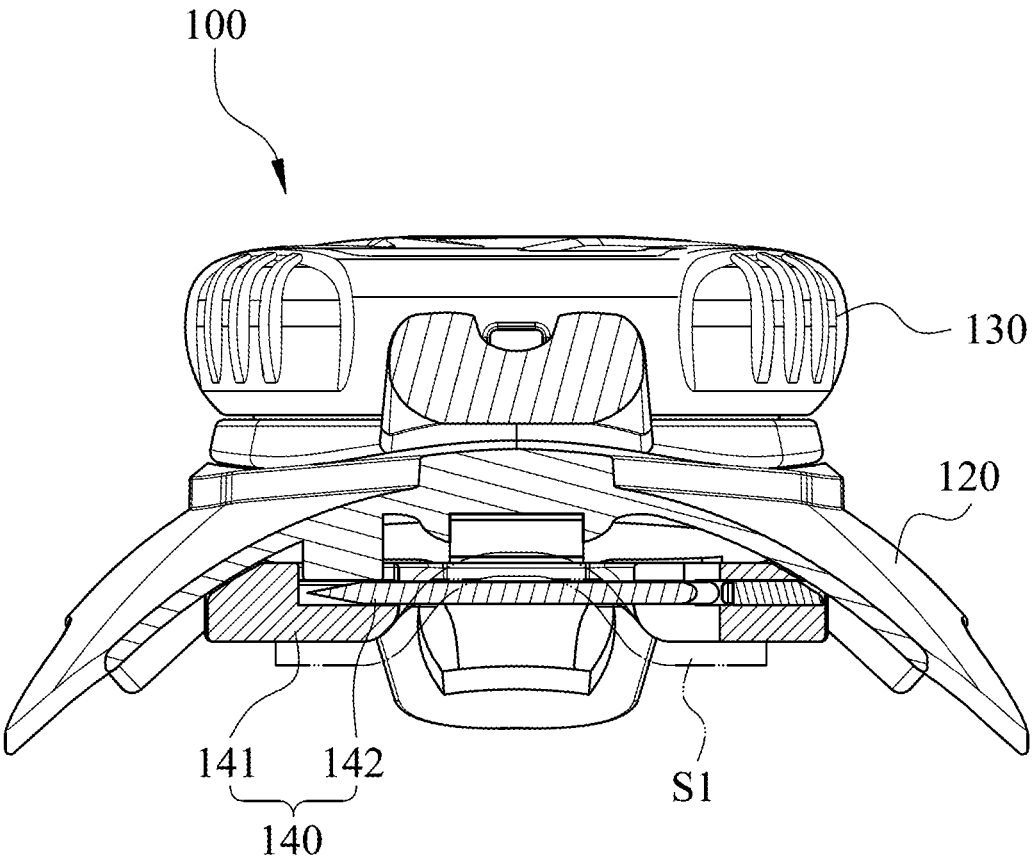
FIG. 8 shows a cross-sectional schematic view of the fastening device of the 1st embodiment in FIG. 1 secured on the article.

Please refer to FIGS. 7 and 8. FIG. 7 shows an operation flow of the installing assembly 140 of the fastening device 100 taken along line 7-7 of the 1st embodiment in FIG. 6. FIG. 8 shows a cross-sectional schematic view of the fastening device 100 of the 1st embodiment in FIG. 1 secured on the article S1. As shown in FIG. 7, each of the needles 142 has been switched to the inserting location perpendicular to the base plate 141, so the needles 142 can be inserted from the first surface S11 of the article S1 into the second surface S12 of the article S1 to form the inserting holes H1. Without being taken out, the needles 142 can be inserted directly from the second surface S12 of the article S1 into the first surface S11 of the article S1 to form other inserting holes H2. Hence, the base plate 141 can be fixed to the first surface S11 of the article S1. Then, the base 120 and the reel part 130 are assembled, and the fastening device 100 is installed on the article S1 as shown in FIG. 8.

Figure 9:
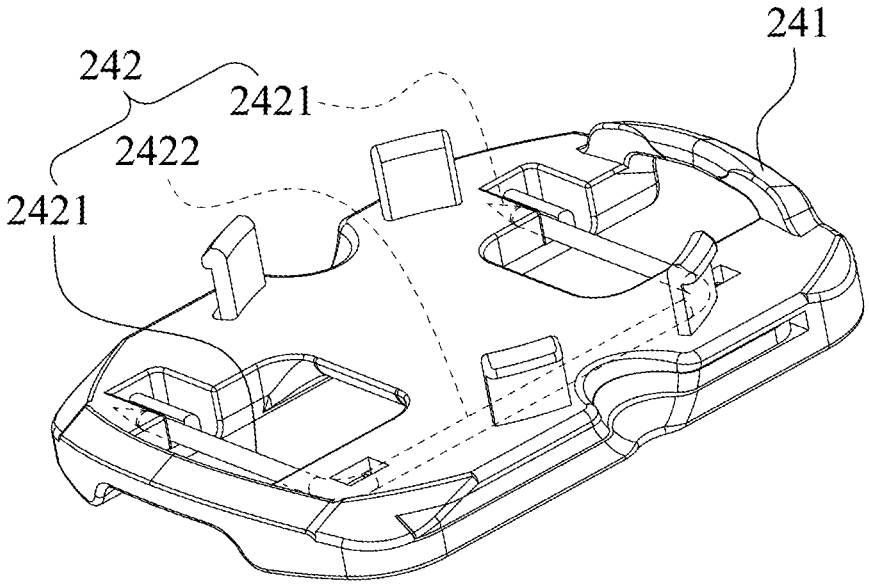
FIG. 9 shows a three-dimensional schematic view of an installing assembly of a fastening device according to the 2nd embodiment of the present disclosure.

Please refer to FIG. 9. FIG. 9 shows a three-dimensional schematic view of an installing assembly 240 of a fastening device according to the 2nd embodiment of the present disclosure. The fastening device of the 2nd embodiment is similar with the fastening device 100 of the 1st embodiment, and the only difference is the structure of the installing assembly 240. In detail, a base plate 241 of the installing assembly 240 is an integrated structure and a number of the pivot holes (not shown) is two. A number of the needle 242 is one and the needle 242 includes two inserting sections 2421 and one pivot section 2422. The two inserting sections 2421 and the pivot section 2422 are connected to form a U-shape, and each of the two inserting sections 2421 corresponds to each of the two pivot holes.

Figure 10:
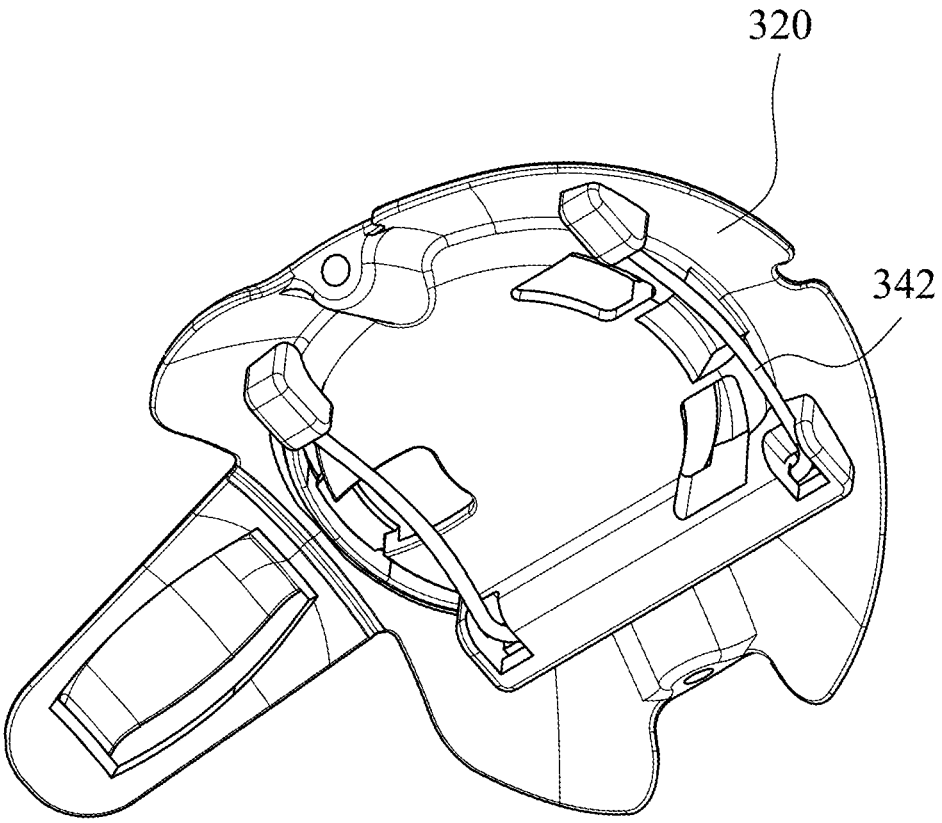
FIG. 10 shows a schematic view of a base and a needle of a fastening device according to the 3rd embodiment of the present disclosure.

Please refer to FIG. 10. FIG. 10 shows a schematic view of a base 320 and a needle 342 of a fastening device according to the 3rd embodiment of the present disclosure. The fastening device of the 3rd embodiment is similar with the fastening device 100 of the 1st embodiment, and the only difference is that the installing assembly does not include a base plate. Thus, the base 320 can include at least one pivot hole (not shown). The at least one pivot hole is located at a base body of the base 320 and configured for the at least one needle 342 to be pivotally disposed thereon. Hence, the aforementioned at least one needle 342 can be pivotally disposed on the base 320 directly. Moreover, the aforementioned at least one needle 342 can be arc-shaped so as to avoid pressing against the instep of a foot.

Figure 11:
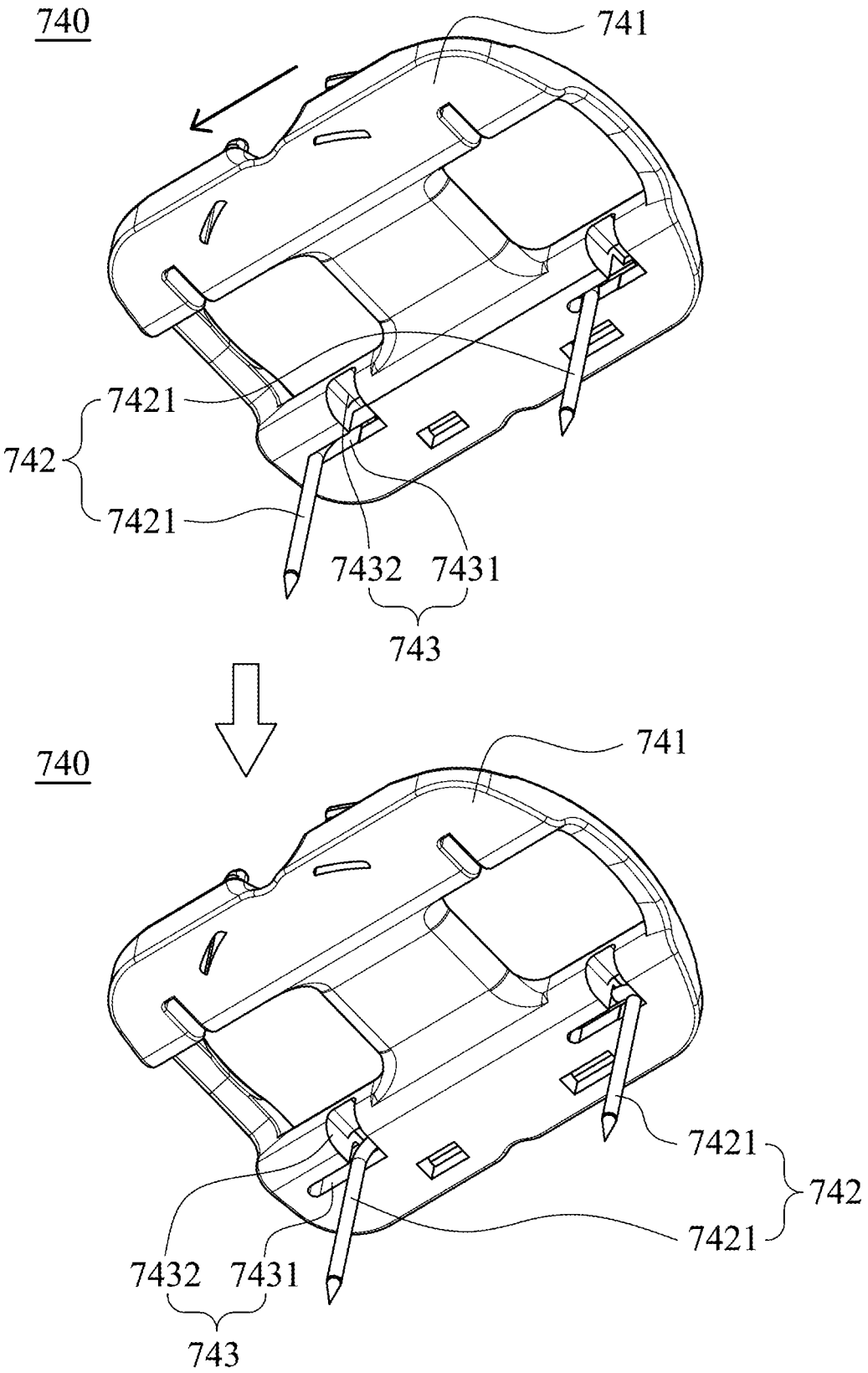
FIG. 11 shows an operation flow of an installing assembly of a fastening device according to the 4th embodiment of the present disclosure.

Please refer to FIG. 11. FIG. 11 shows an operation flow of an installing assembly 740 of a fastening device according to the 4th embodiment of the present disclosure. The fastening device of the 4th embodiment is similar with the fastening device of the 2nd embodiment, and the only difference is that each of pivot holes 743 of the installing assembly 740 can include a restricting section 7431 and an unlocking section 7432. Each of the unlocking sections 7432 is communicated with and perpendicular to each of the restricting sections 7431. Each of the inserting sections 7421 is in a locked state when received in each of the restricting sections 7431, and each of the inserting sections 7421 is in an unlocked state when received in each of the unlocking sections 7432.

In detail, each of the restricting sections 7431 and each of the unlocking sections 7432 are connected to form an L-shape. With the configuration, each of the inserting sections 7421 is received in each of the restricting sections 7431 so that each of the needles 742 cannot rotate relatively to a base plate 741. The base plate 741 is positioned in a restricting location so that the needles 742 are in the locked state. Because each of the inserting sections 7421 cannot rotate, the inserting sections 7421 can be remained in an inserting direction which is favorable for the user to insert the inserting sections 7421 into the article. After each of the inserting sections 7421 is inserted into the article, the user can push the base plate 741 so that the base plate 741 can be positioned in an unlocked state. Via a space of each of the unlocking sections 7432 which allows each of the inserting sections 7421 to be in the unlocked state and rotate relatively to the base plate 741, the base plate 741 can be parallel disposed on the first surface of the article.

Figure 12:
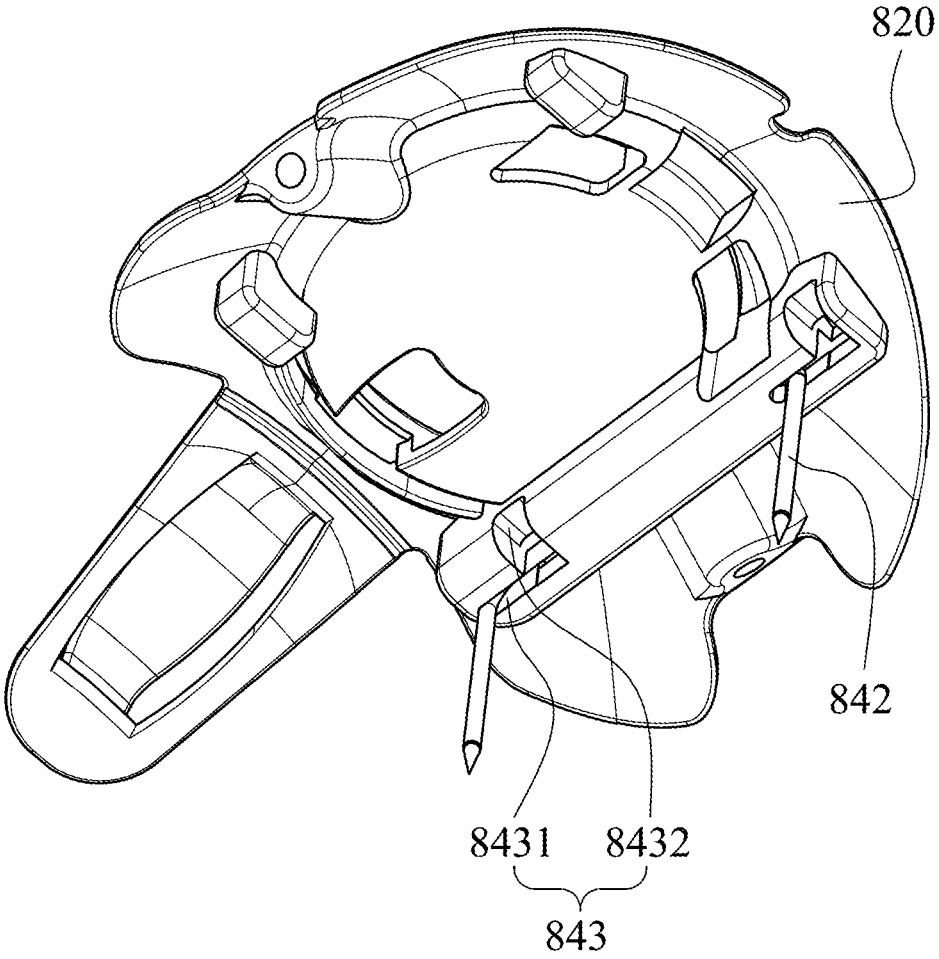
FIG. 12 shows a schematic view of a base and needles of a fastening device according to the 5th embodiment of the present disclosure.

Please refer to FIG. 12. FIG. 12 shows a schematic view of a base 820 and needles 842 of a fastening device according to the 5th embodiment of the present disclosure. The base 820 and the needles 842 of the 5th embodiment are similar with the base 320 and the needles 342 of the 3rd embodiment, but each of pivot holes 843 of the 5th embodiment includes a restricting section 8431 and an unlocking section 8432. The structures and the functions of the restricting section 8431 and the unlocking section 8432 are the same as the structures and the functions of the restricting section 7431 and the unlocking sections 7432 of the 4th embodiment, and it will not be mentioned again here.

Figure 13:
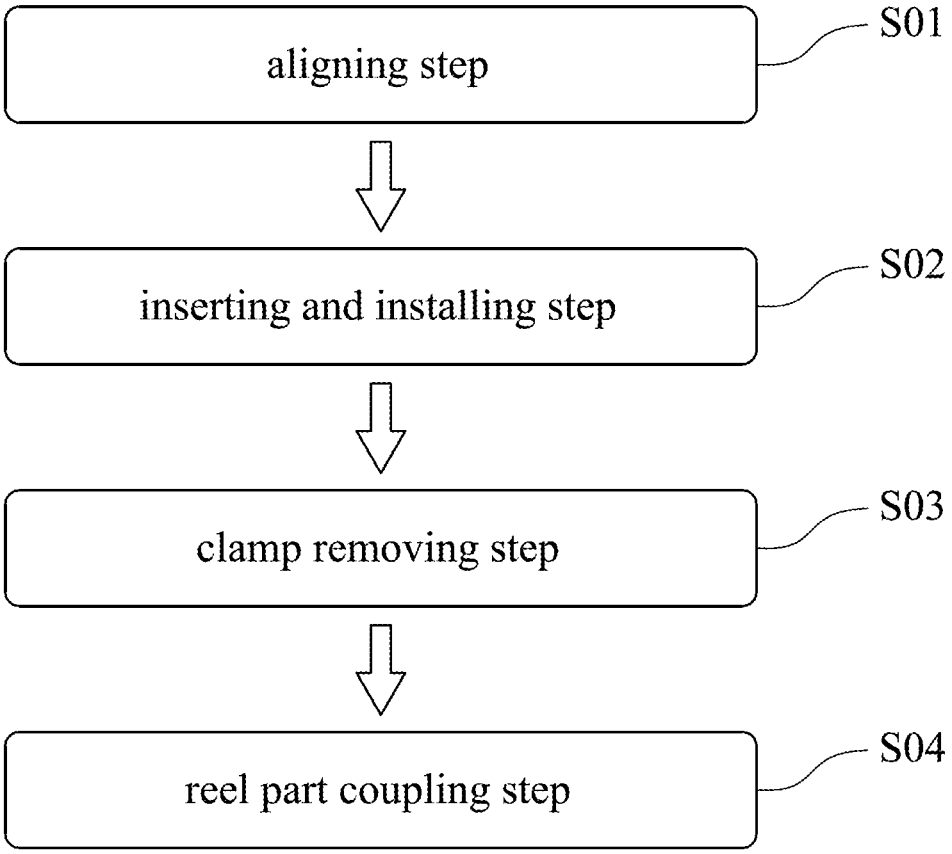
FIG. 13 shows a block diagram of a method for installing a fastening device according to the 6th embodiment of the present disclosure.
Figure 14:
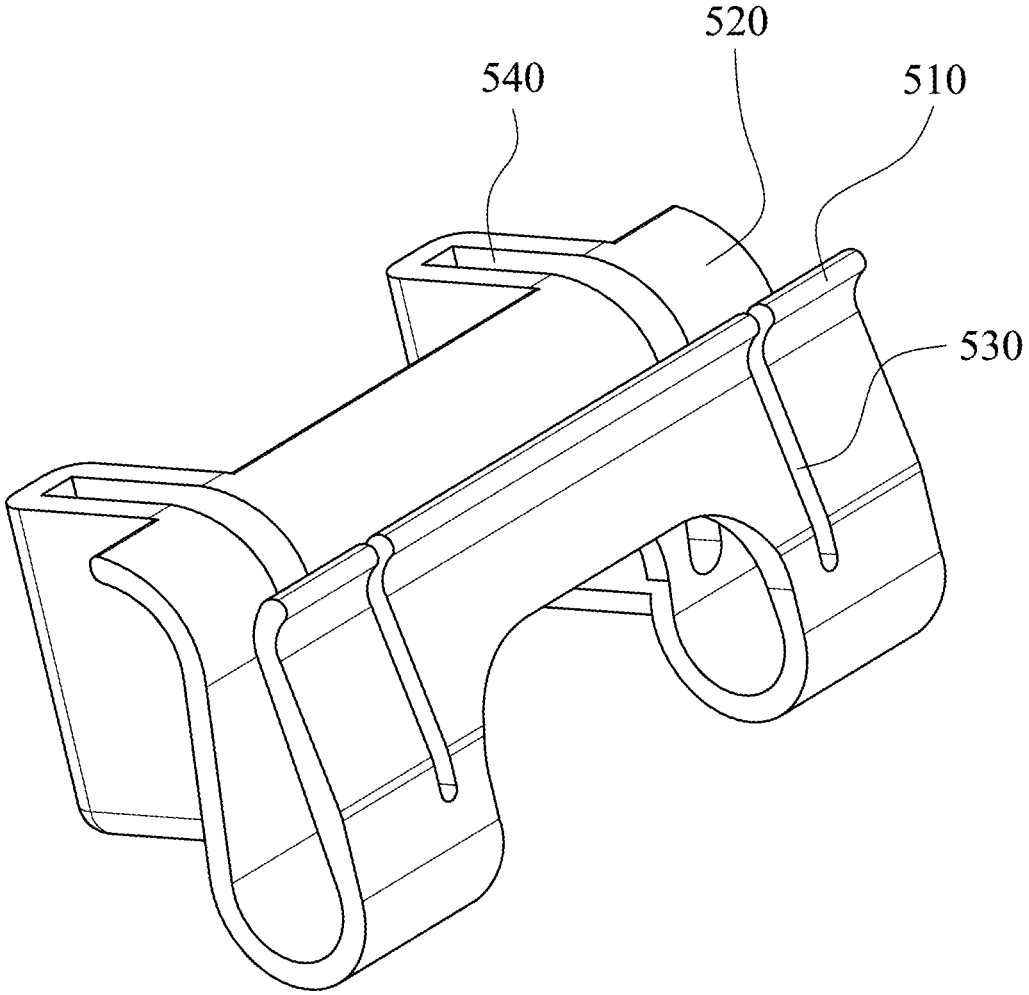
FIG. 14 shows a three-dimensional schematic view of a clamp used in the method of the 6th embodiment in FIG. 13.
Figure 15:
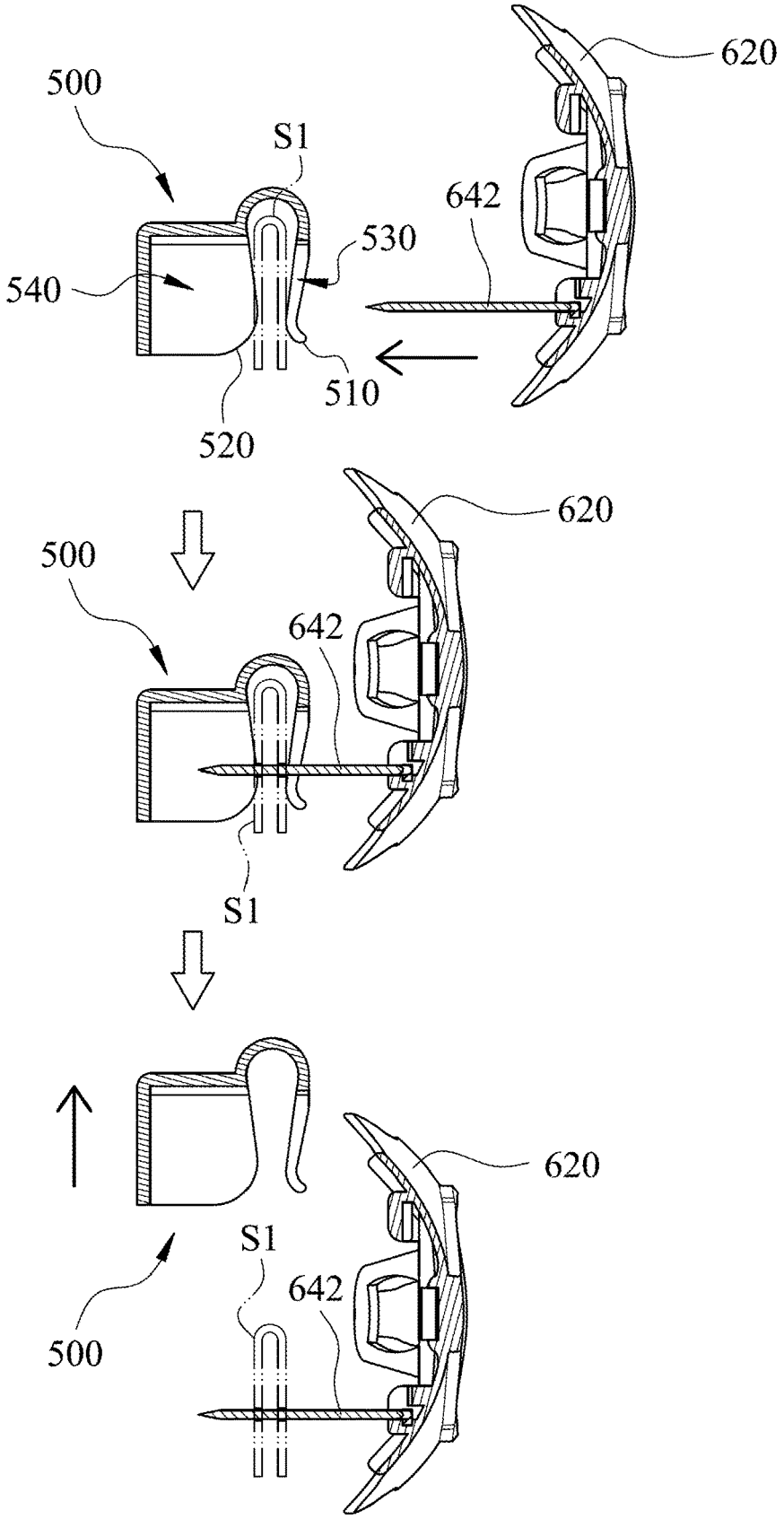
FIG. 15 shows an operation flow of the method of the 6th embodiment in FIG. 13.

Please refer to FIGS. 13, 14 and 15. FIG. 13 shows a block diagram of a method 400 for installing a fastening device according to the 6th embodiment of the present disclosure. FIG. 14 shows a three-dimensional schematic view of a clamp 500 used in the method 400 of the 6th embodiment in FIG. 13. FIG. 15 shows an operation flow of the method 400 of the 6th embodiment in FIG. 13. The method 400 for installing the fastening device includes performing an aligning step S01 and performing an inserting and installing step S02. The aligning step S01 is to align at least one needle 642 of a fastening device with an article S1. The inserting and installing step S02 is to insert an inserting section (its numeral reference is omitted) of the at least one needle 642 from a first surface (its numeral reference is omitted) of the article S1 into a second surface (its numeral reference is omitted) of the article S1, then insert the inserting section of the at least one needle 642 from the second surface of the article into the first surface of the article, and restrict the inserting section of the at least one needle 642 to the article S1.

In detail, in the aligning step S01, the article S1 is bended to form a protrusion, the protrusion is positioned via a clamp 500, the clamp 500 includes two positioning portions 510, 520 which are spaced apart from each other, and the two positioning portions 510, 520 abut against two sides of the protrusion, respectively. In the inserting and installing step S02, the at least one needle 642 is inserted into a groove 530 on the positioning portion 510 of the clamp 500, passed through the protrusion, and then inserted into another groove 540 on the positioning portion 520, so that the at least one needle 642 is restricted to the article S1.

As shown in FIG. 14, the positioning portions 510, 520 are connected to each other to form a U-shaped clamping arm structure. As shown in FIG. 15, the U-shaped clamping arm structure can clamp and position the protrusion. A number of the grooves 530 is two, and the two grooves 530 are spaced apart from each other and disposed on the positioning portion 510. A number of the grooves 540 is two, and the two grooves 540 are spaced apart from each other and disposed on the positioning portion 520. Each of the grooves 530 corresponds to each of the grooves 540. In the configuration, the clamp 500 can be configured to be removed from the article S1 by pulling upwardly, and the at least one needle 642 will not affect the removing. Via the configuration of the clamp 500, it is favorable for the penetration of the at least one needle 642. When the fastening device is equipped with the clamp 500, the method 400 can further include performing a clamp removing step S03 configured for removing the clamp 500 to release the protrusion. In other embodiments, the clamp and the clamp removing step can be excluded, and the present disclosure is not limited thereto.

Furthermore, in the inserting and installing step S02, the aforementioned at least one needle 642 is switched from a locked state to an unlocked state, the at least one needle 642 in the locked state is prohibited from rotating relatively to a base 620 of the fastening device, and after the inserting section of the at least one needle 642 is restricted to the article S1, the at least one needle 642 is switched to the unlocked state so as to allow the at least one needle 642 to rotate relatively to the base 620 of the fastening device.

Moreover, the method 400 can further include performing a reel part coupling step S04. The base 620 is directly connected to the at least one needle 642 such as the base 820 and the needles 842 in FIG. 12. A reel part of the fastening device can be mounted on the base 620 of the fastening device, and the assembly can be completed.

In other embodiments, in the reel part coupling step, a base of the fastening device can be mounted on a base plate of the fastening device, and a reel part of the fastening device can be mounted on the base. The base plate is connected to the aforementioned at least one needle. The fastening device can be the fastening device 100 in FIGS. 1-8, and the base plate and the needle can be the same as the base plate 141 and the needle 142, or the base plate 241 and the needle 242 in FIG. 9.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, configured to be installed on an article, and the fastening device comprising:

a base located on the article;

an installing assembly, comprising:

at least one needle pivotally disposed at the base so as to rotate relatively to the base; and a reel part coupled to a lace and disposed on the base;

wherein the at least one needle is inserted from a first surface of the article into a second surface of the article, then inserted from the second surface of the article into the first surface of the article, and the at least one needle is restricted to the article for securing the base on the first surface of the article.

2. The fastening device of claim 1, wherein the installing assembly further comprises:

a base plate detachably mounted on the base and configured for the at least one needle to be pivotally disposed thereon.

3. The fastening device of claim 2, wherein the base comprises at least one engaging portion, the base plate comprises at least one buckling portion, and the at least one buckling portion is correspondingly engaged with the at least one engaging portion.

4. The fastening device of claim 2, wherein the installing assembly further comprises:

at least one pivot hole located at the base plate and configured for the at least one needle to be pivotally disposed thereon.

5. The fastening device of claim 1, wherein the installing assembly further comprises:

at least one pivot hole located at a base body of the base and configured for the at least one needle to be pivotally disposed thereon.

6. The fastening device of claim 4, wherein a number of the at least one needle is one, the needle comprises two inserting sections and a pivot section, the two inserting sections and the pivot section are connected to form a U-shape, a number of the at least one pivot hole is two, and each of the two inserting sections corresponds to each of the two pivot holes.

7. The fastening device of claim 6, wherein each of the two pivot holes comprises:

a restricting section; and an unlocking section communicated with and perpendicular to the restricting section;

wherein each of the two inserting sections is in a locked state when received in each of the restricting sections, and each of the two inserting sections is in an unlocked state when received in each of the unlocking sections.

8. The fastening device of claim 6, wherein the installing assembly further comprises two through holes, the two through holes are disposed at the base plate and spaced apart from each other, and each of the two through holes corresponds to each of the two inserting sections.

9. The fastening device of claim 2, wherein the at least one needle is fixed to the base plate.

* * * * *